US006028255A

United States Patent [19]

Myronyk

[11] Patent Number: 6,028,255

[45] Date of Patent: Feb. 22, 2000

[54] DETACHABLE NECK FOR A GUITAR

[76] Inventor: Charles E. Myronyk, 1801 E. 5th Ave., Vancouver, British Columbia, Canada, V5N 1L9

[21] Appl. No.: 09/251,201

[22] Filed: Feb. 16, 1999

[51] Int. Cl.[7] ..... G10D 3/00

[52] U.S. Cl. ..... 84/293; 84/291; 84/290

[58] Field of Search ..... 84/267, 291, 293, 84/290

[56] References Cited

U.S. PATENT DOCUMENTS

| | | | |
|---|---|---|---|
| D. 295,932 | 5/1988 | Hayashi | D6/416 |
| 3,130,625 | 4/1964 | Savona | 84/267 |
| 4,073,211 | 2/1978 | Jorgensen | 84/291 |
| 4,111,093 | 9/1978 | Field et al. | 84/267 |
| 4,191,085 | 3/1980 | Litwin | 84/293 |
| 4,686,882 | 8/1987 | Shaw | 84/291 |
| 5,353,672 | 10/1994 | Stewart | 84/291 |
| 5,383,385 | 1/1995 | Gilbert | 84/267 |
| 5,390,578 | 2/1995 | Raymer | 84/291 |
| 5,437,904 | 8/1995 | Lawrence | 428/91 |

FOREIGN PATENT DOCUMENTS 2045993 11/1980 United Kingdom .

OTHER PUBLICATIONS

Internet page for The Roadster Travel Guitar, www.roadsterguitar.com, Jun. 22, 1999.

*Primary Examiner*—Robert E. Nappi
*Assistant Examiner*—Shih-yung Hsieh
*Attorney, Agent, or Firm*—Kolisch Hartwell Dickinson McCormack & Heuser

[57] ABSTRACT

A detachable neck for a guitar allows guitar strings to remain in place and a lever action pivoting the neck to the body about a pivot point under the strings allows full string tension to be obtained. The neck joint attachment may be incorporated in new guitars or retrofitted to existing guitars. The attachment for detaching a guitar neck from a guitar body comprises anchor blocks, one attached to the neck, the other to the body, contact surfaces on the anchor blocks position the neck on the body, and a latch plate on the neck, spaced from the anchor blocks and a latch mechanism for attachment to the guitar body to fasten the latch plate and hold the guitar firmly to the guitar body with the contact surfaces engaged.

20 Claims, 5 Drawing Sheets

DETACHABLE NECK FOR A GUITAR

FIELD OF THE INVENTION

The present invention relates to guitars and more specifically to a detachable neck for a guitar that can either be incorporated into a guitar design or, alternatively, can be retrofitted to many existing guitars.

DESCRIPTION OF RELATED ART

Both acoustic and electric guitars are generally made as a single unit and therefore are fairly bulky when transported from one place to another in their travelling cases. While travelling by air most guitarists would prefer not to check their guitars into baggage due to the rough handling they will invariably receive. However most airlines will not allow guitars in aircraft cabins due to size regulations.

Various attempts have been made to provide collapsing guitars. One example is an electric guitar shown in U.S. Pat. No. 5,383,385 to Gilbert which is a specially designed collapsible guitar wherein the head stock is hinged to the guitar neck and a special link connection joins the guitar neck to the body of the guitar. Furthermore, two sides of the guitar are removable and the unit can be packed into a comparatively small space. While perhaps appropriate for electric guitars, this mechanism would not be adaptable for retrofitting an existing guitar and would not be adaptable for an acoustic guitar.

Another collapsible guitar is shown by Jorgensen in U.S. Pat. No. 4,073,211. In this arrangement the guitar neck folds downward into a recess provided in the guitar body. However, the strings must be disengaged before the mechanism can operate.

One type of travelling guitar is referred to as "The Martin Back Packer" which is a lightweight guitar with a small body that is not foldable. Unfortunately, the acoustic properties of such guitars are greatly reduced, rendering them more suitable for practice than performing. While the body of such a guitar can be reduced in size, string length and neck length cannot be changed without adversely affecting the guitar's tuning and playing characteristics.

SUMMARY OF THE INVENTION

The present invention provides a neck joint attachment system that can be used for easily detaching a guitar neck from a guitar body and may be retrofitted to many types of either acoustic or electric guitars. In the case of an acoustic guitar, the guitar neck may be detached from the guitar body and then fitted into the guitar body for compact storage.

The present invention also provides a guitar having a neck joint attachment so that the neck can be quickly and easily detached from and reattached to the guitar body, without the use of tools and without removing the guitar strings, such that when reassembled, restringing or major retuning is not required.

The attachment includes a first anchor block attached to the guitar body and a second anchor block attached to the guitar neck. The anchor blocks have contact surfaces and to join the guitar neck to the guitar body, the guitar neck is pivoted about the contact surfaces of the anchor block so the guitar strings are tensioned. When locating surfaces on the guitar neck and the guitar body are in contact, and the neck is pushed downward, the tension in the guitar strings holds the neck to the body at the anchor blocks. A latch mechanism is provided to retain the neck and the body together. Preferably, the latch mechanism is cam actuated. When the neck is to be detached from the body of the guitar, the latch mechanism in released and the neck is pushed downwards, pivoting about the contact surfaces. A downward push is required to overcome tension in the strings to allow the latch mechanism to disengage. Then, as the locating surfaces can be separated, tension in the strings is released and the neck and body can be separated.

A string retainer is provided on the head stock between the tuning machines and the finger board nut. The string retainer holds the strings in place when the neck is detached and there is no tension in the strings. Without the string retainer, the strings tend to loosen on the machine head posts.

In yet another embodiment there is provided a locating pin which fits within the body of an acoustic guitar and has an engagement hole at the end of the guitar neck so that the guitar neck can be located within the guitar body when it is detached for storing in a compact position.

The present invention provides a neck joint attachment for detaching a guitar neck from a guitar body, comprising a first anchor block for attachment to a first locating surface on the guitar body, the first anchor block having a first contact surface, a second anchor block for attachment to the guitar neck, the second anchor block having a second contact surface to engage with the first contact surface of the first anchor block to position the guitar neck on the guitar body, a latch plate for attachment to a second locating surface on the guitar neck, spaced from the second anchor block, and a latch mechanism for attachment to the guitar body to fasten the latch plate and hold the guitar neck firmly to the guitar body with the first contact surface and the second contact surface engaged.

The present invention also provides a guitar having a neck joint attachment to detach a guitar neck from a guitar body, the guitar comprising a guitar body with a first locating surface, a first anchor on the first locating surface of the guitar body, the first anchor having a first contact surface, a second anchor on the guitar neck, the second anchor having a second contact surface to engage with the first contact surface of the anchor, the guitar neck having a second locating surface spaced from the second anchor, a latch plate on the second locating surface of the guitar neck, and a latch mechanism in the guitar body to fasten to the latch plate and hold the guitar neck firmly to the guitar body with the first contact surface and the second contact surface engaged.

In yet a further embodiment of the present invention there is provided a method of connecting a detachable guitar neck to a guitar body and retain guitar string tension, comprising the steps of pivoting the guitar neck about contact surfaces on anchors forming a pivot point on the guitar body beneath the guitar strings, the pivot point positioned so the tension in the guitar strings hold the guitar neck to the guitar body when the guitar neck is in place on the guitar body, and latching the guitar neck to the guitar body at a location spaced from the pivot point to hold the guitar neck and the guitar body together and retain the guitar strings in tension.

BRIEF DESCRIPTION OF THE DRAWINGS

In drawings which illustrate embodiments of the present invention.

DESCRIPTION OF THE PREFERRED EMBODIMENTS

Figure 2:
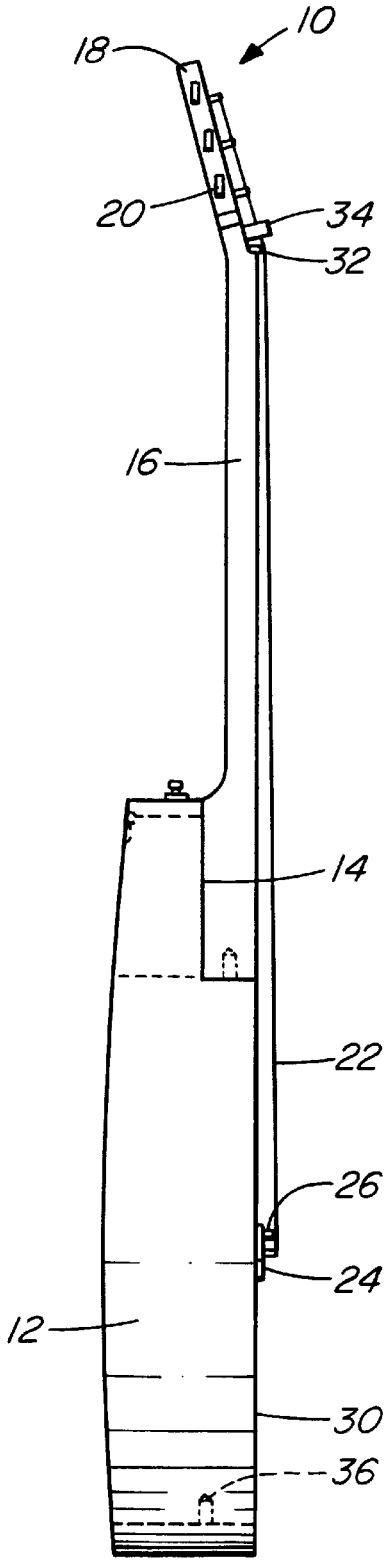
FIG. 2 is a side view showing the guitar of FIG. 1 in the assembled condition.
Figure 1:
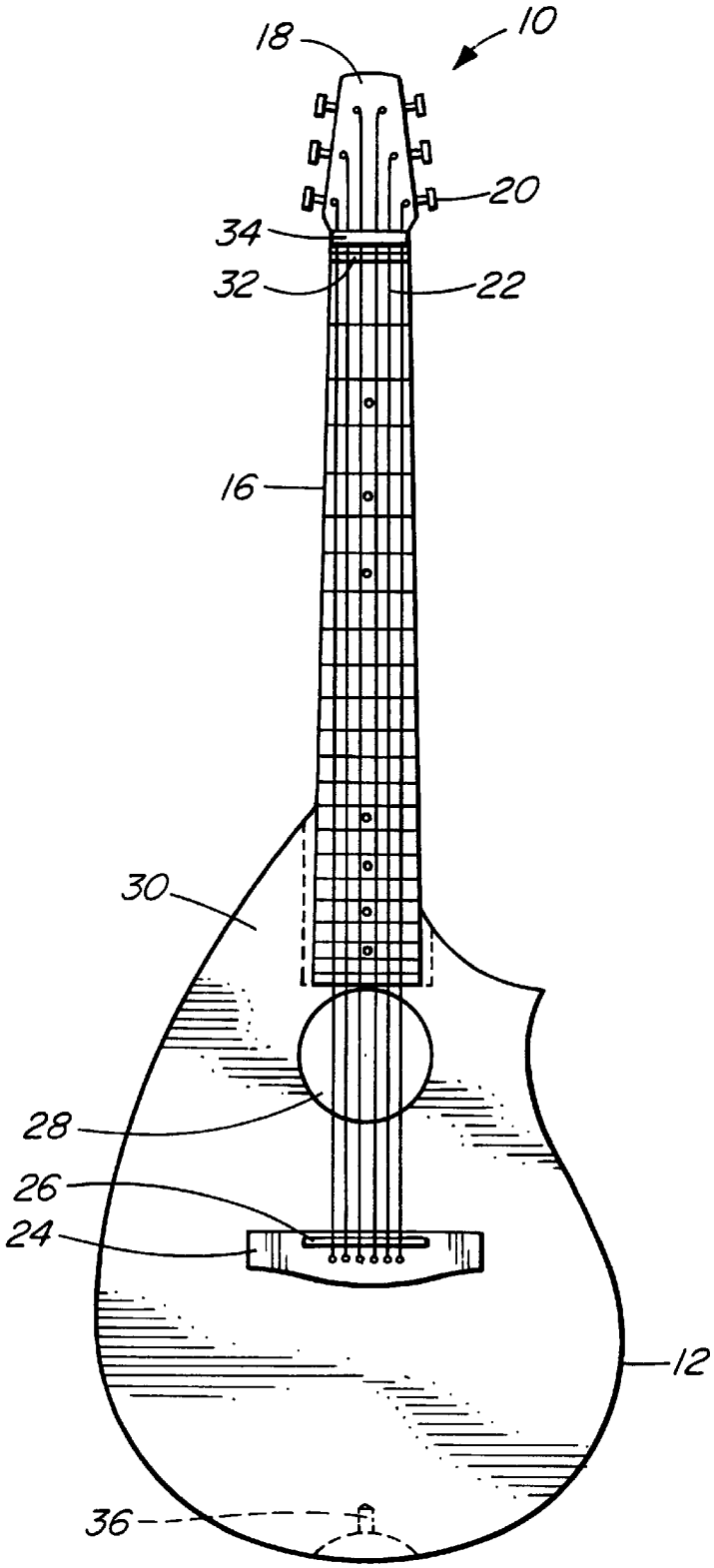
FIG. 1 is a front view showing a guitar having a neck joint attachment according to one embodiment of the present invention.

FIGS. 1 and 2 show a guitar 10 which is an acoustic guitar and has a hollow guitar body 12 with a neck joint attachment 14 according to one embodiment of the invention for joining the guitar body 12 to the guitar neck 16. The guitar 10 has a head stock 18 at the end of the neck 16 with adjustment pivots 20, generally referred to as tuning machines holding guitar strings 22 which are anchored to a saddle 26 over a sound bridge 24 on the guitar body 12. An acoustic opening 28 in the top panel 30 of the body 12 is aligned below the guitar strings 22. There is a finger board nut 32 or comb structure which supports the string 22 at the join between the head stock 18 and the guitar neck 16. A string retainer 34 is provided adjacent the finger board nut 32 for tensioning the strings 22. The purpose of the string retainer 34 will be explained hereafter.

Figure 3:
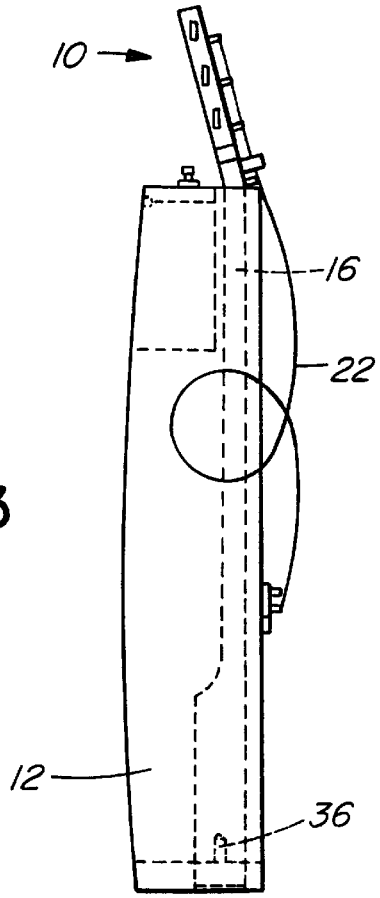
FIG. 3 is a side view of the guitar shown in FIGS. 1 and 2 with the neck stored within the guitar body.

When the guitar neck 16 is detached from the guitar body 12 in an acoustic guitar, the neck 16 fits within the body as shown in FIG. 3 and a locating pin 36 as shown in FIG. 3 and in more detail hereafter locates the neck 16 in the body. Whereas this arrangement is suitable for an acoustic guitar, an electric guitar having a solid body does not permit the neck 16 to be placed within the body but can be packed beside the body with suitable attachment means to hold the neck 16 and the body 12 together without removing the strings, preferably in a case or container.

Figure 4:
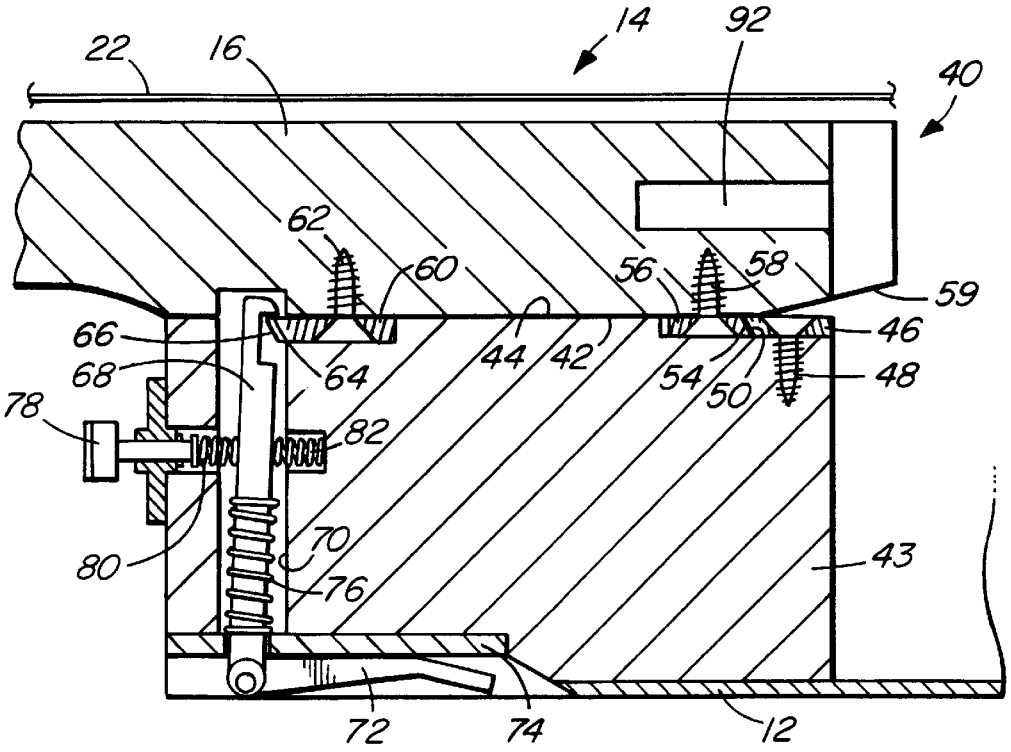
FIG. 4 is a partial sectional view showing the attachment between a guitar neck and a guitar body with the guitar neck assembled to the guitar body.
Figure 5:
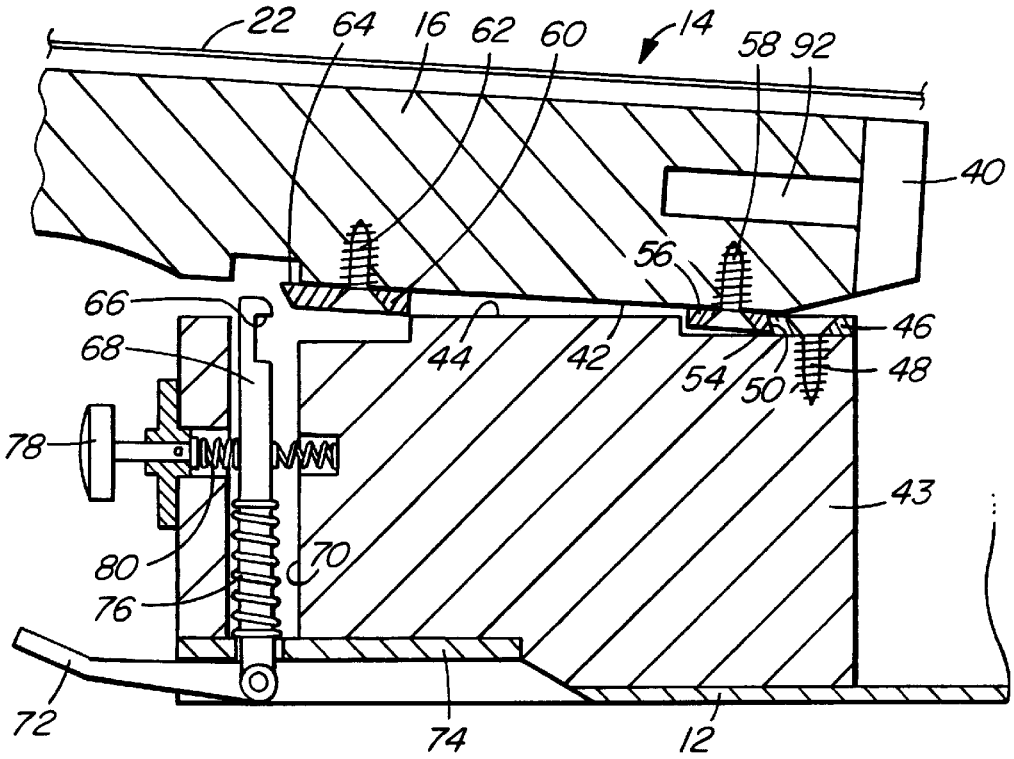
FIG. 5 is a partial sectional view showing the attachment between a guitar neck and a guitar body as shown in FIG. 4 with the guitar neck released from the latch mechanism.
Figure 6:
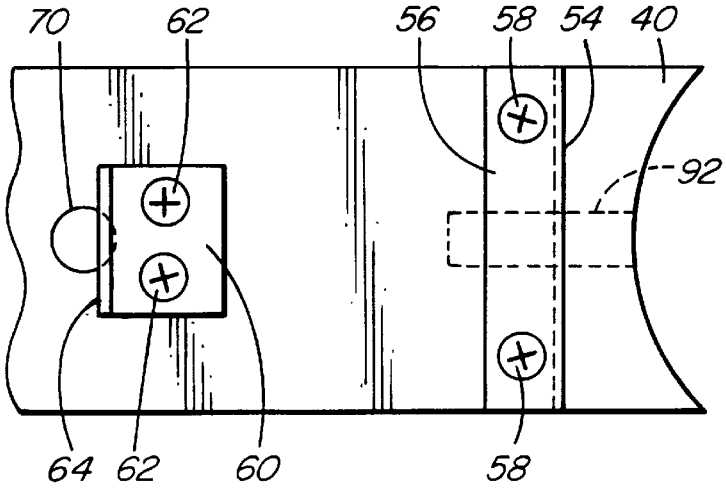
FIG. 6 is an underside view of a guitar neck showing an anchor block and latch plate according to one embodiment of the present invention.

One type of neck joint attachment 14 is shown in FIGS. 4, 5 and 6 wherein the mounting end 40 of the guitar neck 16 is shown assembled to the guitar body 12 with a first locating surface 42 on the mounting end 40 of the neck 16 that is aligned with and adjacent a second locating surface 44 on the guitar body 12. In acoustic guitars the body 12 has a solid portion 43 on which the neck 16 is mounted. In an electric guitar the guitar body 12 is solid therethrough. A first anchor block 46 is shown attached to the body portion 43 by screws 48 and has a first contact surface 50 which contacts a second contact surface 54 of a second anchor block 56 attached by screws 58 to the underside of the mounting end 40 of the neck 16. The first contact surface 50 and the second contact surface 54 are sloped as shown in FIG. 4 to provide a wedge action ensuring that the two anchor blocks 46,56 do not separate when the guitar strings 22 are under tension. The mounting end 40 of the guitar neck 16 has a relieved portion 59 to permit the neck 16 to pivot generally about the contact surfaces 50,54.

A latch plate 60 attached to the guitar neck 16 by screws 62 as shown more clearly in FIG. 6, rests on the second locating surface 44 of the guitar body portion 43. The latch plate 60 has a protruding lip 64 for engagement in a notch 66 of a latch pin 68 located in an aperture 70 of the guitar body portion 43. The latch pin 68 has a cam lever 72 at its base which rests on a cam plate 74. FIG. 4 shows the cam lever 72 in the assembled or locked position against the cam plate 74 with the latch pin 68 in tension with the lip 64 of the latch plate 60 locked in the notch 66 and held in place. The surfaces of the notch 66 and the lip 64 are sloped so that they are wedged in place and cannot easily separate when under tension. A cam spring 76 is provided on the latch pin 68 to hold the latch pin 68 in place to project upwardly from the aperture 70.

A side spring actuator 78 is shown in FIGS. 4 and 5 which, when pushed in and turned to the position shown in FIG. 4, compresses a first side spring 80 to apply a pressure against the latch pin 68 to move it across the aperture 70 and ensure that the notch 66 can engage the lip 64 of the latch plate 60. A second side spring 82 provides a counter pressure in a direction opposite that applied by the first side spring 80 on the latch pin 68. When the side spring actuator 78 is turned to the open position, releasing the first side spring 80, the latch pin 68 is pushed toward the open position as shown in FIG. 5, by second side spring 82.

In operation, when the guitar neck 16 is locked to the body 12, it is in the position shown in FIG. 4 with the first anchor block 46 on the body portion 43 having the first contact surface 50 of the first anchor block 46 touching the second contact surface 54 of the second anchor block 56 on the neck 16. The two contact surfaces 50,54 provide a wedge action which provides a first anchor point for holding the first and second locating surfaces 42 and 44 adjacent and in alignment. At the same time the latch plate 60 has the lip 64 engaged in the notch 66 of the latch pin 68 with the cam lever 72 in the locked position as shown in FIG. 4. This provides a second anchor point spaced apart from the first anchor point, with the cam lever providing a clamping force to hold contact surfaces 42 and 44 in contact with each other. The neck 16 is thus secured to the body 12, with the strings 22 held in tension, and the guitar may be played.

To release the neck 16 from the body 12, the side spring actuator 78 is rotated and moves outwards so the second side spring 82 applies a force to the latch pin 68 in a direction away from the latch plate 60.

The cam lever 72 is rotated to the open position as shown in FIG. 5 and the latch pin 68 is urged by the cam spring 76 to move upward by an amount determined by cam dimensions, increasing projection of the latch pin 68 from the aperture 70. However, tension in the strings 22 provides a force causing the neck 16 to rotate slightly about a pivot region represented by surfaces 50 and 54, such that first and second locating surfaces 42 and 44 are separated by a small amount, but with the notch 66 remaining in engagement with the lip 64, due to frictional forces therebetween caused by the tension in the strings 22 and the angle at which the notch 66 and lip 64 engage. The first and second anchor blocks 46 and 56, in conjunction with the latch pin 68 and latch plate 60, thus hold the neck 16 partially engaged with the body 12, in an intermediate position.

A force is then applied to the neck 16 and the body 12 to rotate the neck 16 about the pivot region represented by surfaces 50 and 54, in a direction that allows the notch 66 on the latch pin 68 to disengage from the lip 64 of the latch plate 60 as shown in FIG. 5, with the second side spring 82 pushing the latch pin 68 away from the latch plate 60 such that the neck 16 may then be rotated in a direction allowing the tension in the strings 22 to be relieved. The two anchor blocks 46,56 may then be separated and the neck 16 may be stored inside the guitar body as shown in FIG. 3 or, alternatively, if the guitar body is a solid electric guitar rather than an acoustic guitar, beside the body.

For assembling the neck 16 to the body 12 the reverse takes place. The cam lever 72 is placed in the unlocked position as in FIG. 5 and the spring actuator 78 and latch pin 68 are placed in the on position similar to FIG. 4 except that latch pin 68 will be positioned at a higher elevation as determined by cam lever 78. The second anchor block 56 on the neck 16 is placed so that the two contact surfaces 50,54 are arranged to touch each other. The neck 16 is then pivoted down as shown in FIG. 5. When the latch plate 60 comes into contact with the latch pin 68, the latch pin is pushed aside against the first side spring 80 so that the lip 64 is able to move past the notch 66, at which point the first side spring 80 pushes the latch pin 68 into a position where the notch 66 is fully engaged with the lip 64.

The cam lever 72 is then rotated to the locked position as shown in FIG. 4 applying a force to the latch pin 68 and the latch plate 60 such that the neck 16 is rotated about the pivot region represented by surfaces 50 and 54 until the locating surfaces 42 and 44 are drawn into full engagement with each other, and the neck 16 thus secured to the body 12, and the strings 22 brought into full tension for playing.

As this mechanism is a positive mechanism and the first and second contact surfaces 50,54 are always brought into the same relative positions when the neck is attached to the body, the effect of removing and replacing the neck 16 from the body 12 does not effect the string tension and major retuning of the guitar is not needed, although fine tuning may be necessary.

Figure 7:
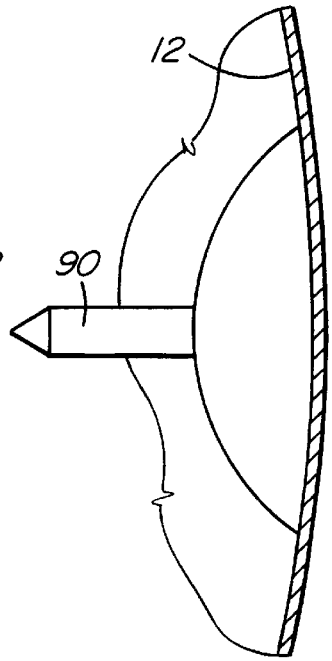
FIG. 7 is a partial interior view showing the inside back of a guitar body with the locating pin for storing the guitar neck therein.

A locating pin 90 is shown in FIG. 7 which is located in the interior at the end of the guitar body 12 as shown in FIG. 3. The locating pin 90 fits into a receiving hole 92 in the mounting end 40 of the neck 16 when it is in the stored position as shown in FIG. 3.

Figure 8:
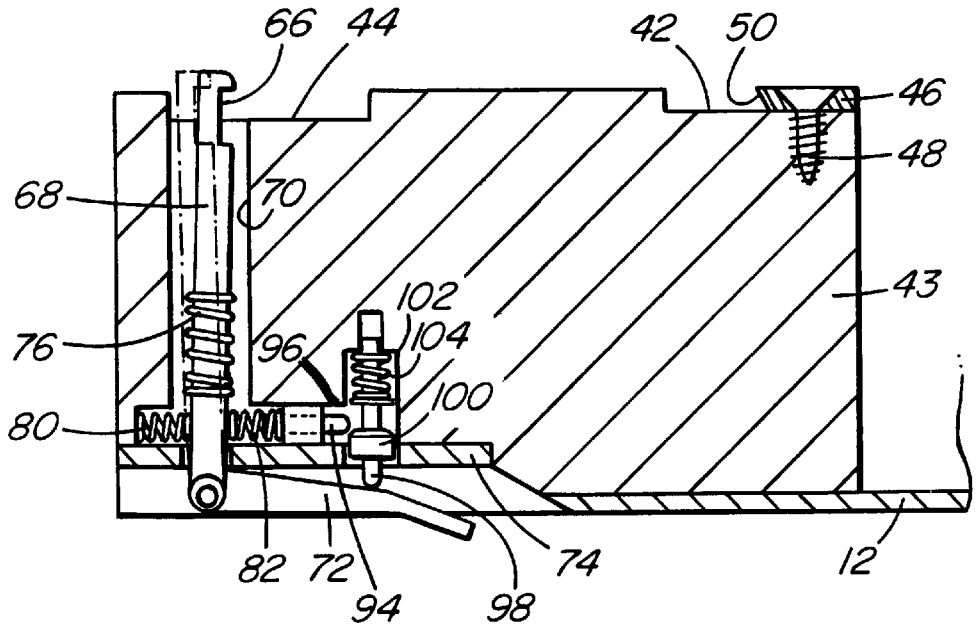
FIG. 8 is a partial sectional view showing a portion of a guitar body similar to that shown in FIGS. 4 and 5 having a different arrangement of latch mechanism.

Another embodiment of a neck joint attachment 14 is shown in FIG. 8 wherein the side spring actuator 78 is replaced by an internal arrangement operated from underneath the guitar body 12. This is suitable for some types of guitars, particularly electric guitars which may not have a suitable body portion 43 as that shown in FIGS. 5 and 6. In this embodiment a side spring actuator rod 94 moves backward and forward in slot 96 and has a first side spring 80 to push against the latch pin 68 and engage the lip 64 of the latch plate 60 in the notch 66, and a second side spring 82 to push against the latch pin 68 from the other side. A pin 98 having a shoulder 100 thereon fits in a hole 102 adjacent the end of the slot 96 and a spring mechanism 104 acts in the same manner as in a ballpoint pen extension and retraction mechanism. When the pin 98 is pushed up, the shoulder 100 pushes the side spring actuator rod 94 to counter the spring pressure from the first side spring 80, so the latch pin 68 moves to the release position to the left as shown in dotted line in FIG. 8. The pin 98 is operated by moving the cam lever 72 into the locked position, with alternate operations of the cam lever 72 reversing the direction in which the side spring forces are applied to the latch pin. To reverse the sideways movement of the latch pin 68, the cam lever 72 is pushed once more against the pin 98 and this disengages the shoulder 100 from the side spring actuator rod 94 so that it moves toward the pin 98 and thus first side spring 80 presses on the latch pin 68 pushing it into the locked position as shown in dark lines in FIG. 8. By using the ballpoint release mechanism a first depression of pin 98 moves the shoulder 100 to a location where it pushes the side spring actuator rod 94 away from the pin 98 and a second depression of the pin 98 moves the shoulder 100 back to the position where the side spring actuator rod 94 moves toward the pin 98 so that pressure is applied by first side spring 80 on the latch pin 68. The mechanism works in exactly the same manner as that shown in FIGS. 4 and 5 with the exception that it is all operated from underneath the guitar with each operation of the cam lever 72, and there is no need to have a side spring actuator 78 at the end of the guitar.

Figure 9:
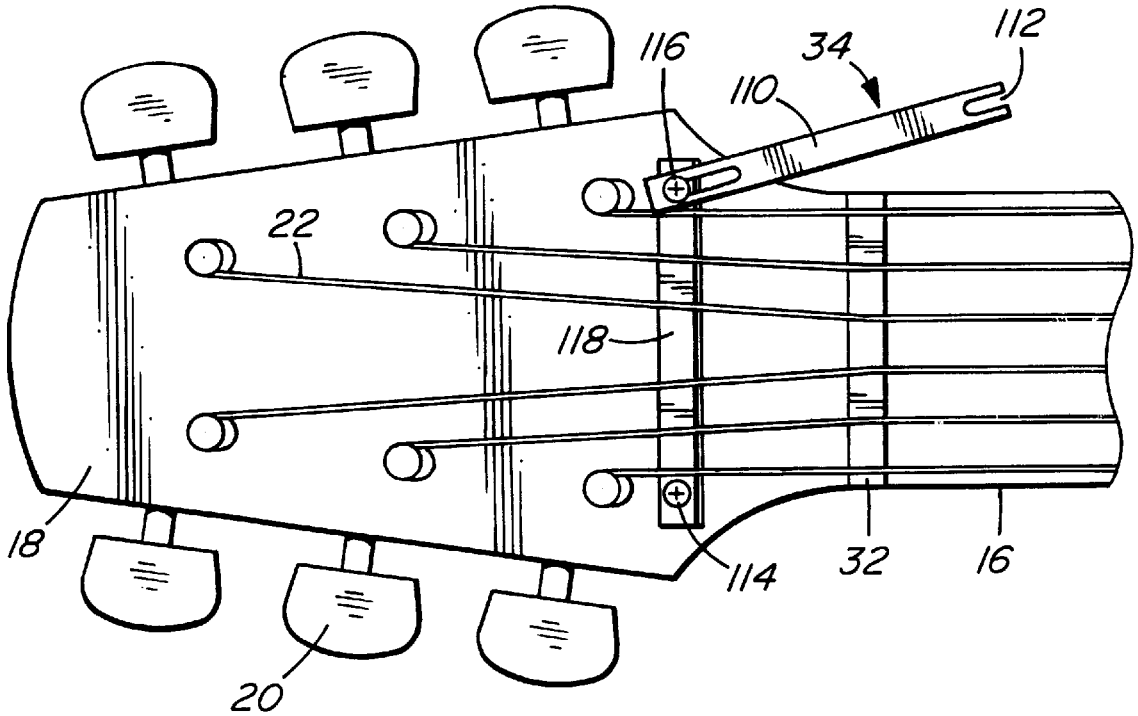
FIG. 9 is a plan view showing a head stock for a guitar with a string retainer according to one embodiment in the open position to permit restringing of the instrument.
Figure 10:
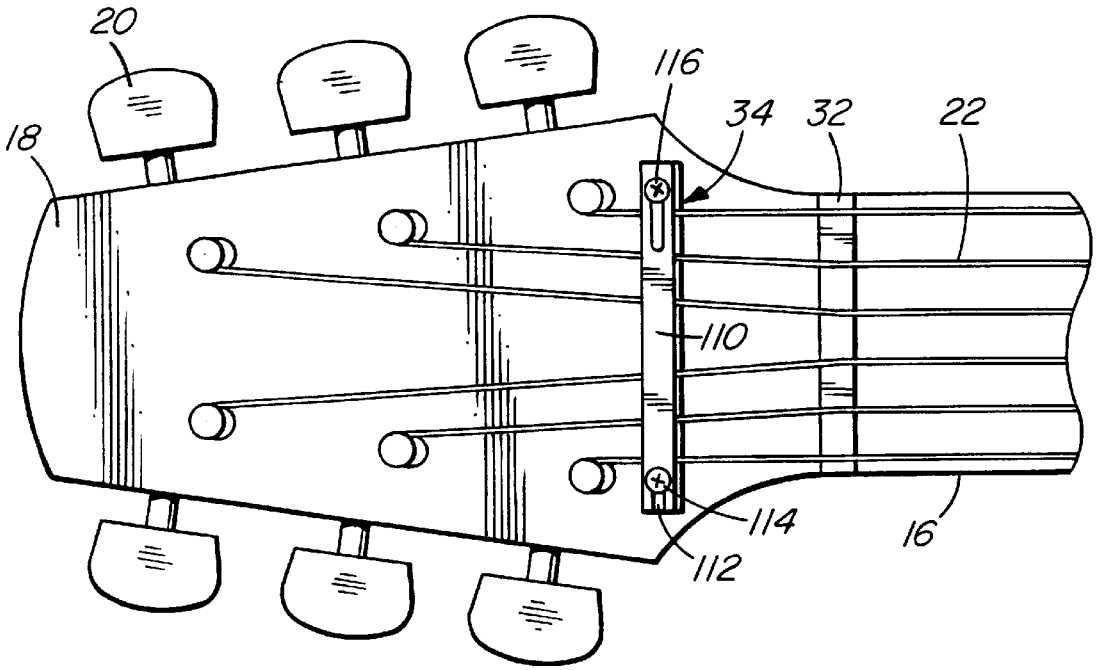
FIG. 10 is a plan view showing the head stock of FIG. 9 with the string retainer in the closed position.
Figure 11:
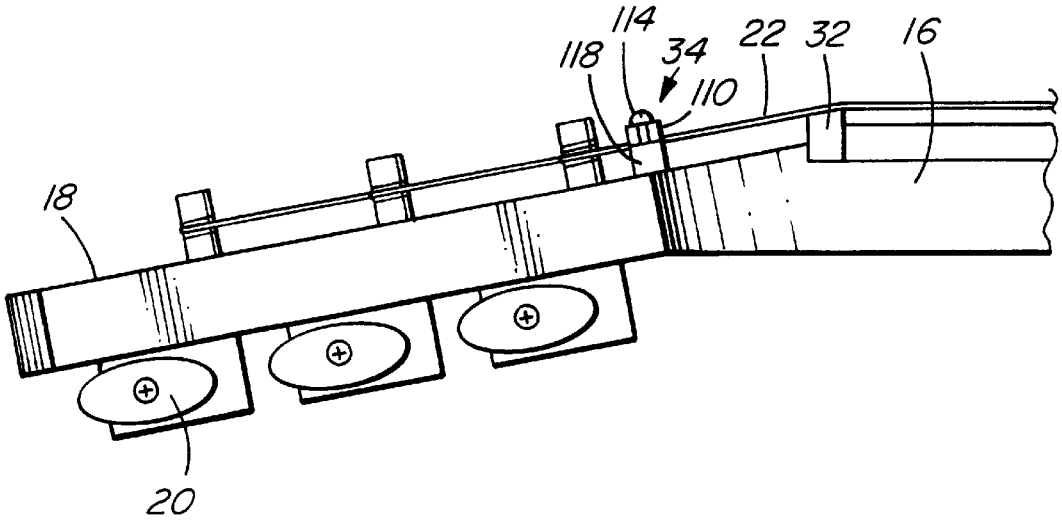
FIG. 11 is a partial side view showing the head stock of FIGS. 9 and 10 with the string retainer in the closed position.

The head stock 18, as shown in FIGS. 9, 10 and 11, has a string retainer 34 located between the finger board nut 32 and the head stock 18. As shown in FIG. 9, a metal arm 110 has a notch 112 at one end which engages in a screw 114 and pivots on a second screw 116 at the other side. A rubber strip 118 rests on a wood spacer (not shown). When the guitar neck 16 is to be removed from the body 12, then tension comes off the strings 22 and it is necessary to ensure that the strings 22 are clamped between the metal arm 110 and the rubber strip 118 so they are retained in position and do not come loose on the tuning machines 20. When it becomes necessary to change one or more strings 22, the metal arm 110 is released by pushing it so as to disengage notch 112 from screw 114, then rotating the arm about screw 116 to allow access to strings 22. After restringing the reverse takes place. The arm 110 is rotated so as to engage slot 112 with screw 114 and the arm is then slid sideways to secure it. Once initially adjusted screws 112 and 116 need not be loosened or tightened for any purpose except to account for wear and tear. The purpose of retainer 34 is not to lock the strings, only restrain them while still providing normal tuning action of the instrument.

It has been found that when the neck 16 is placed into the storage position as shown in FIG. 3, the guitar strings 22 can be coiled inside the guitar body 12. Alternatively, snubbers or straps (not shown) may be provided to prevent the strings 22 from coming loose. Furthermore, snubbers prevent movement between the neck 16 and the body 12 of the guitar when in the storage position.

A retrofit kit may be provided for attachment to existing guitars so that the guitar neck can be made separable from the guitar body. Alternatively, new guitars may be designed with a neck joint attachment that separates so that the neck and body may be separated. The shape of the guitar does not limit the use of the neck joint attachment and in fact the attachment may be designed to suit any stringed instrument such as violin, cello, double bass and the like. In all cases the tension of the strings stabilizes the connection as the string tension pulls the neck into contact with the body.

Various changes may be made to the embodiments shown herein without departing from the scope of the present invention which is limited only by the following claims.

I claim:

1. A neck joint attachment for detaching a guitar neck from a guitar body comprising:

a first anchor block for attachment to a first locating surface on the guitar body, the first anchor block having a first contact surface;

a second anchor block for attachment to the guitar neck, the second anchor block having a second contact surface to engage with the first contact surface of the first anchor block to position the guitar neck on the guitar body;

a latch plate for attachment to a second locating surface on the guitar neck, spaced from the second anchor block, and a latch mechanism for attachment to the guitar body to fasten to the latch plate and hold the guitar neck firmly to the guitar body with the first contact surface and the second contact surface engaged.

2. The neck joint attachment according to claim 1 wherein the first contact surface of the first anchor block and the second contact surface of the second anchor block have complementary slopes to provide wedge action when the guitar neck is joined to the guitar body.

3. The neck joint attachment according to claim 2 wherein the first anchor block and the second anchor block are metal plates.

4. The neck joint attachment according to claim 1 wherein the latch mechanism comprises a latch pin with a notch in a top portion to engage the latch plate, the latch pin being spring loaded and having a cam lever to pull downward and tension the latch pin to hold the latch plate firmly so the guitar neck is locked to the guitar body in a locked position, and including a side spring actuator to push the latch pin sideways to ensure the notch in the latch pin engages the latch plate, the side spring actuator being releasable for disengagement of the latch plate from the notch in the latch pin.

5. The neck joint attachment according to claim 4 wherein the side spring actuator has an operating mechanism to engage and disengage a side spring pushing on the latch pin.

6. The neck joint attachment according to claim 5 wherein the side spring actuator is located at an end of the guitar body.

7. The neck joint attachment according to claim 5 wherein the side spring actuator is incorporated in the body of the guitar operable by the cam lever when moved into the locked position.

8. The neck joint attachment according to claim 1 including a releasable string retainer on a head stock of the guitar neck to retain guitar strings in place on the head stock when tension is off the strings.

9. The neck joint attachment according to claim 8 wherein the releasable string retainer has a rubber strip under the guitar strings, the rubber strip mounted on a base, and including a metal arm having a slot at one end to engage in a hold down screw and retain the guitar strings on the rubber strip.

10. A guitar having a neck joint attachment to detach a guitar neck from a guitar body, the guitar comprising:

a guitar body with a first locating surface;

a first anchor on the first locating surface of the guitar body, the first anchor having a first contact surface;

a second anchor on the guitar neck, the second anchor having a second contact surface to engage with the first contact surface of the first anchor;

the guitar neck having a second locating surface spaced from the second anchor;

a latch plate on the second locating surface of the guitar neck, and a latch mechanism in the guitar body to fasten to the latch plate and hold the guitar neck firmly to the guitar body with the first contact surface and the second contact surface engaged.

11. The guitar according to claim 10 wherein the anchors are metal plates with hold down screws to the guitar neck and guitar body.

12. The guitar according to claim 10 wherein the latch mechanism comprises a latch pin with a notch in a top portion to engage the latch plate, the latch pin being spring loaded and having a cam lever to pull downward and tension the latch pin to hold;

the latch plate firmly so the guitar neck is locked to the guitar body in a locked position, and including a side spring actuator to push the latch pin sideways to ensure the notch in the latch pin engages the latch plate, the side spring actuator being releasable for disengagement of the latch plate from the notch in the latch pin.

13. The guitar according to claim 12 wherein the side spring actuator has an operating mechanism to engage and disengage a side spring pushing on the latch pin.

14. The guitar according to claim 13 wherein the side spring actuator is located at an end of the guitar body.

15. The guitar according to claim 13 wherein the side spring actuator is incorporated in the body of the guitar operable by the cam lever when moved into the locked position.

16. The guitar according to claim 10 including a removable string retainer on a head stock of the guitar neck to retain guitar strings in place on the head stock when tension is off the strings.

17. The guitar according to claim 16 wherein the removable string retainer has a rubber strip under the guitar strings, the rubber strip mounted on a base, and including a metal arm having a slot at one end to engage in a hold down screw and retain the guitar strings on the rubber strip.

18. The guitar according to claim 10 being an acoustic guitar and wherein the neck fits within the guitar body when removed from the body, and the guitar strings are not disconnected.

19. A method of connecting a detachable guitar neck to a guitar body and retain guitar string tension, comprising the steps of:

pivoting the guitar neck about contact surfaces on anchors forming a first anchor point on the guitar body beneath the guitar strings, the first anchor point positioned so the tension in the guitar strings holds the guitar neck to the guitar body when the guitar neck is in place on the guitar body, and latching the guitar neck to the guitar body at a second anchor point spaced from the pivot point to hold the guitar neck and the guitar body together and retain the guitar strings in tension.

20. The method of connecting a detachable guitar neck to a guitar according to claim 19 wherein the latching is a two part latching mechanism and first pushes a latch pin on the guitar body sideways to engage a latch plate on the guitar neck and secondly pulls the latch pin downwards to apply tension between the guitar neck and the guitar body.

* * * * *